US007311596B2

(12) United States Patent
Moshal

(10) Patent No.: US 7,311,596 B2
(45) Date of Patent: Dec. 25, 2007

(54) DECISION SUPPORT SYSTEM AND METHOD OF OPERATION THEREOF

(75) Inventor: Martin Moshal, Marina Bay (GI)

(73) Assignee: Waterleaf Limited, Douglas (IM)

( * ) Notice: Subject to any disclaimer, the term of this patent is extended or adjusted under 35 U.S.C. 154(b) by 198 days.

(21) Appl. No.: 10/504,314

(22) PCT Filed: Feb. 12, 2003

(86) PCT No.: PCT/IB03/00449

§ 371 (c)(1),
(2), (4) Date: Jun. 15, 2005

(87) PCT Pub. No.: WO03/068348

PCT Pub. Date: Aug. 21, 2003

(65) Prior Publication Data

US 2005/0239529 A1 Oct. 27, 2005

(30) Foreign Application Priority Data

Feb. 14, 2002 (GB) ..... 0203517.8

(51) Int. Cl.
*A63F 1/00* (2006.01)

(52) U.S. Cl. ..... 463/12; 463/9; 463/25; 273/139

(58) Field of Classification Search ..... 463/12, 463/16, 17, 20
See application file for complete search history.

(56) References Cited

U.S. PATENT DOCUMENTS 3,962,800 A * 6/1976 Feldheim ..... 434/129
4,339,134 A * 7/1982 Macheel ..... 463/12
5,046,735 A 9/1991 Hamano et al.
5,265,009 A * 11/1993 Colavita ..... 463/1
5,476,259 A 12/1995 Weingardt
5,630,753 A 5/1997 Fuchs
RE35,864 E 7/1998 Weingardt
5,830,067 A 11/1998 Graves et al.
5,984,779 A 11/1999 Bridgeman et al.
6,012,983 A * 1/2000 Walker et al. ..... 436/20
6,131,906 A * 10/2000 Green ..... 273/148 R (Continued)

OTHER PUBLICATIONS

Aiello, W., et al., "Using smartcards to secure a personalized gambling device," Conference on Computer and Communications, Proceeding of the 6th ACM, 1999, pp. 128-137.
Pérez-Uribe, A., et al., "Blackjack as a Test Bed for Learning Strategies in Neural Networks," Proc. IEEE Intl. Joint Conf. on Neural Networks, IJCNN'98, Anchorage, May 4-9, 1998, 3:2022-2027.

(Continued)

*Primary Examiner*—Xuan M. Thai
*Assistant Examiner*—Joshua P Wert
(74) *Attorney, Agent, or Firm*—McDonnell Boehnen Hulbert & Berghoff LLP

(57) ABSTRACT

A decision support system comprises a decision repository with at least one stored game play decision for a particular hand held by a player and a corresponding first card held by a dealer, in a game of blackjack, and a programming facility operable, selectively, by the player to amend the at least one stored game play decision. The decision repository has a stored game play decision for every possible combination of a particular hand held by the player and corresponding first card held by the dealer. The stored game play decision is a recommended game play decision for the player, namely a decision to hit, to stand, to split to double, or to surrender

12 Claims, 2 Drawing Sheets

U.S. PATENT DOCUMENTS

| | | | | |
|---|---|---|---|---|
| 6,244,957 | B1 | 6/2001 | Walker et al. | |
| 6,508,709 | B1 | 1/2003 | Karmarkar | |
| 2003/0027632 | A1 * | 2/2003 | Sines et al. | 463/29 |
| 2003/0069071 | A1 | 4/2003 | Britt et al. | |

OTHER PUBLICATIONS

Weeks, M., et al., "Dealing from idea to silicon: the Blackjack tutor chip," IEEE Potentials, Apr./ May 1999, 18(2):38-42.

Conway, D.G., et al., "Casino Gambling on the Internet: Scope, Issues, and Opportunities," Jan. 13, 1998, http://citeseer.nj.nec.com/347763.html, downloaded Apr. 14, 2003, pp. 1-27.

Conway, D G., et al., "Caveat Mercator in Electronic Commerce: A Gaming Example," Sep. 26, 1998, http://citeseer.nj.nec.com/286576.html, downloaded Apr. 14, 2003, pp. 1-33.

Olson, D.K., "Learning to Play Games From Experience: An Application of Artificial Neural Networks and Temporal Difference Learning," Dec. 1993, http://citeseer.nj.nec.com/olson93learning.html, downloaded Apr. 14, 2003, pp. 1-82.

International Search Report for parent application PCT/IB03/00449, issued May 6, 2003, 2 pages.

Supplementary European Search Report for related application EP 03739607.4, issued May 3, 2006, 3 pages.

* cited by examiner

DECISION SUPPORT SYSTEM AND METHOD OF OPERATION THEREOF

FIELD OF THE INVENTION

This invention relates to a decision support system that enables a user thereof to play a game and, more particularly, to a decision support system that enables a user thereof to play a game of chance, in this instance, a game of blackjack. The invention extends to a method of operation of the decision support system.

BACKGROUND TO THE INVENTION

The game of blackjack is well known and widely played in most land-based casinos.

At the simplest level, the game of blackjack is played between each one of a number players, normally from 1 to 7 players, and a dealer who represents a "house". During a turn of the game, each player is required to make an initial wager on the outcome of two separate hands of playing cards, one hand to be dealt to the player and the other hand to be dealt to the dealer, respectively. After making the initial wager, each player is dealt two cards face up, and the dealer is dealt one card face up, from one or more decks of 52 playing cards.

Each card is deemed to have a point value as follows: a deuce to a ten is deemed to have a point value equal to the face value of that card; a Jack, a Queen or a King is deemed to have a value of 10, while an Ace is deemed to have a value of 1 or, optionally, 11, at the discretion of the player and the dealer, respectively.

Each player is then required to decide, on the basis of the two playing cards which have been dealt to him, and the dealer's exposed playing card, whether to draw additional cards, one at a time, to augment the player's hand (that is, to "hit"), or not to draw any further additional cards for augmentation of the player's hand (that is, to "stand"). If the total point value of the cards in the player's hand exceeds 21 at any stage, the player is deemed to have "bust", in which case the player's initial wager is forfeited to the house, and the player takes no further part in that turn of the game.

Once each player in that turn of the game has elected to stand, or has bust, the dealer augments his hand by drawing additional cards, one at a time, according predetermined rules, an example of which may be:

1. the dealer must hit if the total point value of the cards in the dealer's hand is less than 17;
2. the dealer must stand if the total point value of the cards in the dealers hand in greater than or equal to 17;
3. the dealer busts if the total point value of the cards in the dealer's hand is greater than 21. If the dealer busts while the player has not, the player wins the initial wager at even money.

Where neither the player nor the dealer has bust, the outcome of the wager is decided by comparing the total point value of the player and dealer hands. If the players hand has the higher total point value, the player wins the initial wager at even money. If the dealer's hand has the higher point value, the player's initial wager is forfeited to the house. In the event that the total point values of the player and dealers hands are equal, the outcome of the game is a tie and the initial wager is neither forfeited nor won by the player. There are numerous variations to these rules of the game of blackjack, which are not material to the invention, and which will not be described here in detail.

It is known that the game of blackjack is a game where a player's skill is a major determinant of success or failure in the game. It is also well known that an unskilled player should play the game according to a certain predefined basic strategy in order to minimise an advantage that the game offers to an operator of the game. A disadvantage of the game of blackjack is that the rules of the basic strategy can be tedious to learn and to master. A further aspect of the game of blackjack is that a number of turns of the game are dealt from a shoe consisting of, typically, five conventional decks of 52 playing cards each. Successive turns of the game are thus not independent and are influenced by the cards that have been dealt from the shoe in preceding turns of the game, until the five decks in the shoe are re-shuffled. An unskilled player can thus find the game of blackjack particularly daunting and be reluctant to play the game for fear of making incorrect game play decisions.

It is desirable for an operator of a game of blackjack that the rate at which successive turns of the game can be played be speeded up in order to increase a turnover of wagers that are made on the game.

OBJECT OF THE INVENTION

It is an object of this invention to provide a decision support system, and a method of operation thereof, that will, at least partially, alleviate the above-mentioned difficulties and disadvantages.

SUMMARY OF THE INVENTION

In accordance with this invention there is provided a decision support system, comprising:

a decision repository having at least one stored game play decision for a particular hand held by a player and a corresponding first card held by a dealer, in a game of blackjack; and a programming facility operable, selectively, by the player to amend the at least one stored game play decision.

Further features of the invention provide for the decision repository to have a stored game play decision for every possible combination of a particular hand held by the player in the game of blackjack and a corresponding first card held by the dealer, for the stored game play decision to be a recommended game play decision for the player, and for the recommended game play decision to be any one of a decision to hit, to stand, to split, to double, or to surrender.

Still further features of the invention provide for the system to include a display facility configurable to display to the player any recommended game play decision from the decision repository, the recommended game play decision corresponding to a combination of a particular hand held by the player in a turn of the game of blackjack and a corresponding first card held by the dealer, alternatively for the decision support system to be configurable to automatically control the progress of at least one turn of the game of blackjack in accordance with any recommended game play decision from the decision repository, without intervention from the player.

The invention extends to a method of operation of a decision support system, comprising the steps of:

providing a decision repository having at least one stored game play decision for a particular hand held by a player and a corresponding first card held by a dealer, in a game of blackjack; and selectively operating a programming facility to amend the at least one stored game play decision.

There is further provided for storing in the decision repository a stored game play decision for every possible combination of a particular hand held by the player in the game of blackjack and a corresponding first card held by the dealer, for recommending a stored game play game play decision to the player when a combination of a particular hand is held by the player in the game of blackjack and a corresponding first card is held by the dealer, and for recommending to the player any one of a decision to hit, to stand, to split, to double, or to surrender.

There is still further provided for displaying to the player any recommended game play decision from the decision repository on a display facility configurable to display to the player, the recommended game play decision corresponding to a combination of a particular hand held by the player in a turn of the game of blackjack and a corresponding first card held by the dealer, alternatively for automatically controlling the progress of at least one turn of the game of blackjack in accordance with any recommended game play decision from the decision repository, without intervention from the player.

BRIEF DESCRIPTION OF THE DRAWINGS

A preferred embodiment of the invention is described below, by way of example only, and with reference to the accompanying drawings in which.

DETAILED DESCRIPTION OF THE INVENTION

Figure 1:
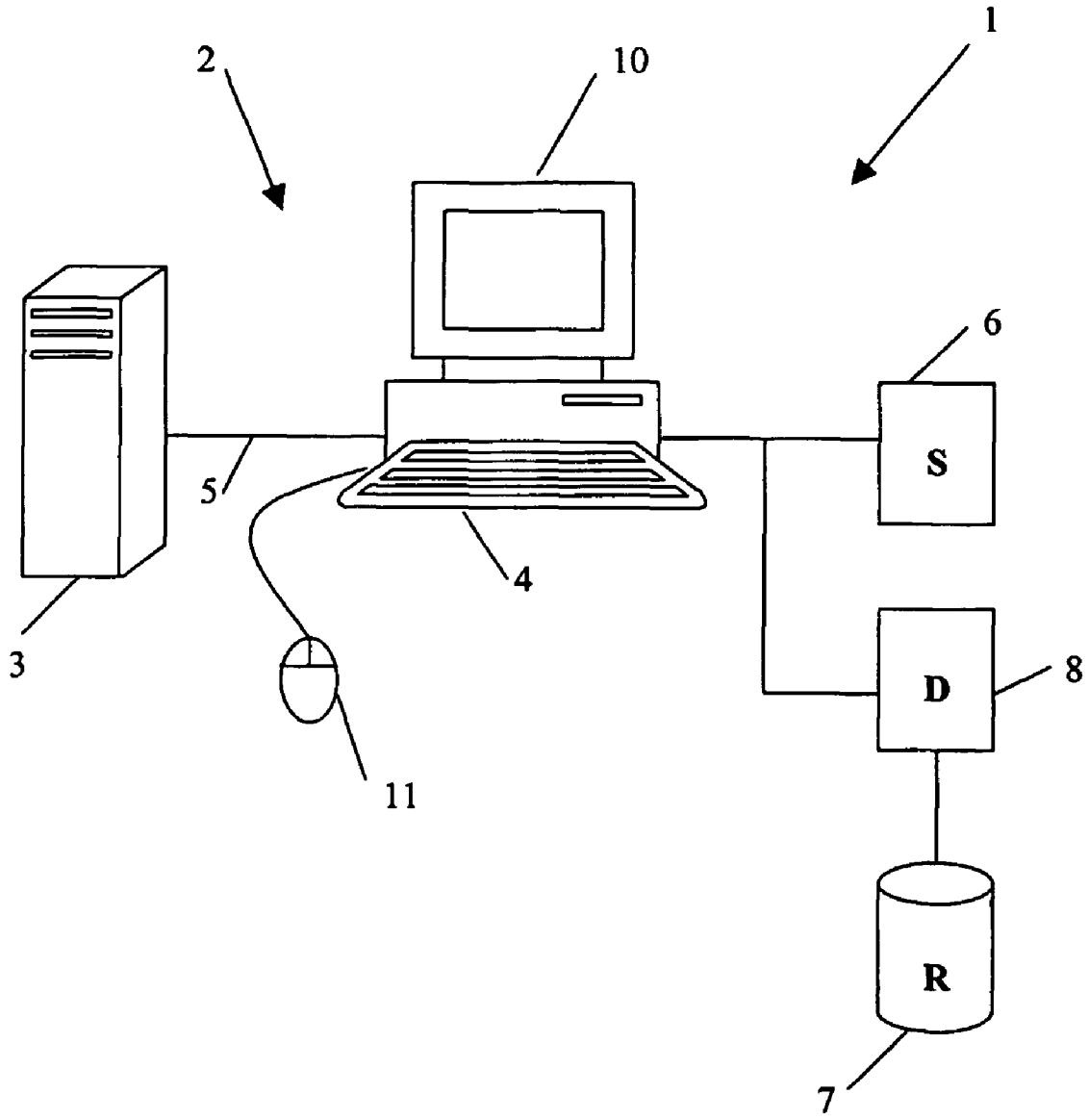
FIG. 1 is a schematic representation of a decision support system, according to the invention.
Figure 2:
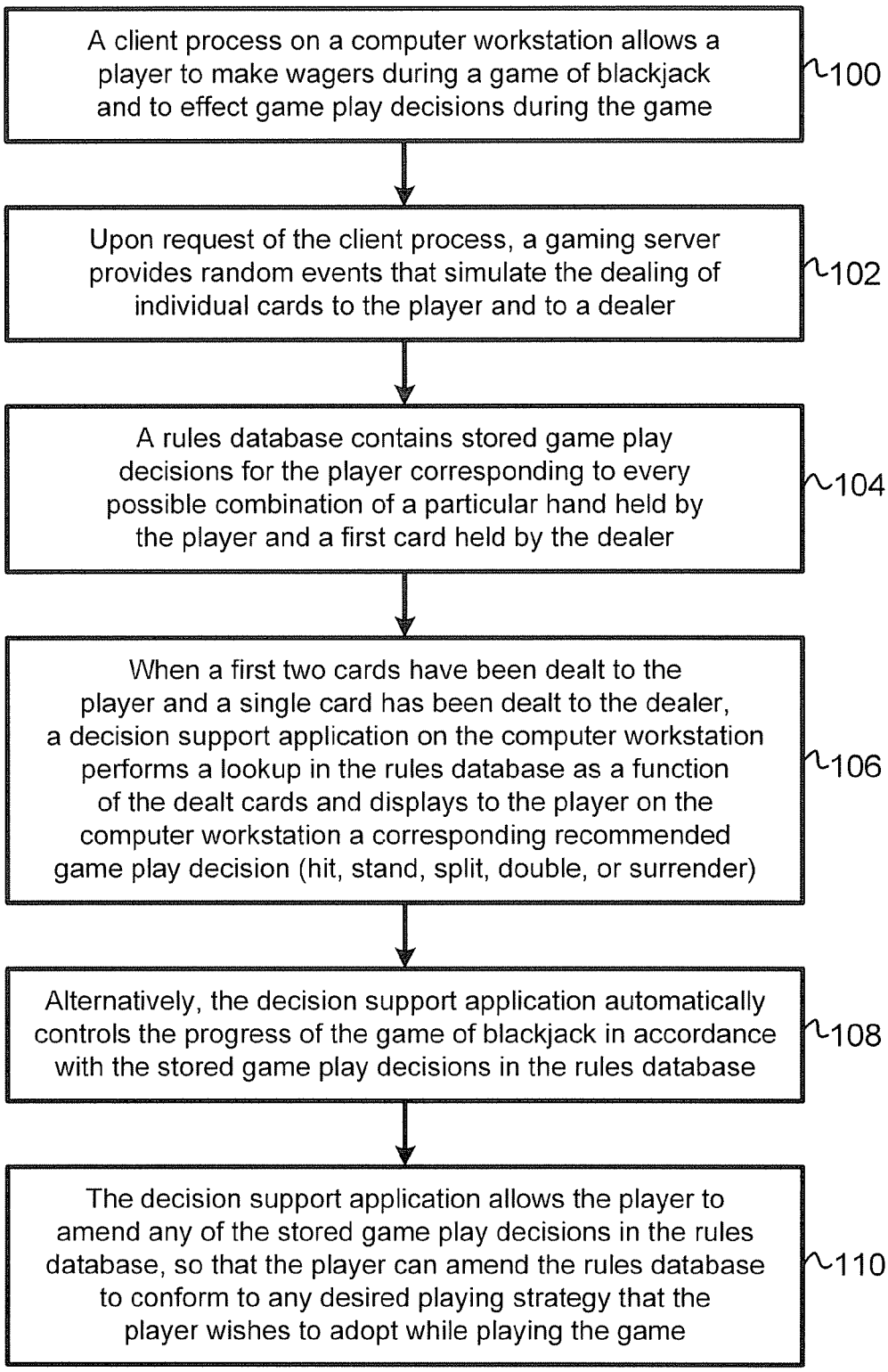
FIG. 2 is a flow chart illustrating a method of operating a decision support system, according to the invention. A client process on a computer workstation allows a player to make wagers during a game of blackjack and to effect game play decisions during the game (block 100). Upon request of the client process, a gaining server provides random events that simulate the dealing of individual cards to the player and to a dealer (block 102). A rules database contains stored game play decisions for the player corresponding to every possible combination of a particular hand held by the player and a first card held by the dealer (block 104). When a first two cards have been dealt to the player and a single card has been dealt to the dealer, a decision support application on the computer workstation performs a lookup in the rules database as a function of the dealt cards and displays to the player on the computer workstation a corresponding recommended game play decision (hit, stand, split, double, or surrender) (block 106). Alternatively, the decision support application automatically controls the progress of the game of blackjack in accordance with the stored game play decisions in the rules database (block 108). The decision support application allows the player to amend any of the stored game play decisions in the rules database, so that the player can amend the rules database to conform to any desired playing strategy that the player wishes to adopt while playing the game (block 110).

Referring to FIG. 1, a decision support system is indicated generally by reference numeral (1). The decision support system is shown in conjunction with a gaming facility, indicated generally by reference numeral (2) for playing a game of blackjack at an on-line casino (not shown).

The gaming facility (2) includes a gaming server (3) and a player access facility (4) in the form of a computer workstation with an associated display monitor (10) and a pointing device (11), such as a mouse or, alternatively, a touchpad. The computer workstation (4) is located remotely from the gaming server (3) and communication between the computer workstation and the gaming server is provided across a communication network (5) that is, in this embodiment, the Internet.

The computer workstation (4) operates under control of a stored program (6), the precise operation of which is not germane to the scope of the invention, and which will not be described here in detail. The stored program (6) enables the player to play the game of blackjack at the on-line casino (not shown). The blackjack casino game consists of a server process, which is executable on the gaming server (3), and a client process that is executable in the computer workstation (4) and which is the stored program (6). The server process simulates, upon request of the client process, one or more random events, such as the dealing of individual cards in a hand of blackjack to the player and to a dealer representing a casino operator, or house. The stored program (6), or client process, allows the player to make wagers on a turn of the game, and to effect decisions on the turn of the game, such as standing, hitting, splitting, doubling and surrendering, as a function of the cards which are held by the player and the dealer, respectively, at any stage during the turn of the game.

The decision support system (1) consists of a decision repository in the form of a rules database (7), and a decision support software application program (8), which is executable in the computer workstation (4). The rules database (7) contains, for each possible combination of the cards of the blackjack hand held by the player, and a first card held by the dealer, a corresponding stored game play decision. Each stored game play decision is an optimal, or recommended, game play decision for the player corresponding to a particular combination of held cards. Each recommended game play decision is a decision to hit, to stand, to split, to double, or to surrender, as appropriate, as a function of the held cards.

In use, during a turn of the game of blackjack, when a first two cards have been dealt to the player and a single card has been dealt to the dealer, the decision support application program performs a lookup in the rules database (7) as a function of the dealt cards and displays to the player on the computer workstation (4) a corresponding recommended game play decision. The recommended game play decision is displayed to the player on the computer workstation by means of a dialogue box or a button. The player is then able to either follow the recommended game play decision, or to ignore it, at his discretion. A further game play decision is recommended to the player in this manner at every subsequent decision point in the turn of the game of blackjack, such as where the player has previously hit, split or doubled in that particular turn of the game.

It will be appreciated by those skilled in the art that the decision support system (1) described above will enable the player to play the game of blackjack without having to memorise any game play strategy, as such a strategy can be encoded in the rules database (7). It is envisaged that the decision support system (1) will heighten a player's enjoyment of the game as it enables the player to make a correct game play decision at all decision points in the game, and will help to sustain the player's interest in the game over a period of time.

The technical problem solved by this invention is to provide a decision support system that provides a player with real-time feedback on game play decisions required to play a game. The game play decisions can be implemented and executed by the player in a "man-in-the-loop" configuration. Alternatively, the decision support system may include a closed loop feedback path and a control engine that automates the game play strategy without further intervention from the player. The game play strategy is configurable at the instance of the player.

Numerous modifications are possible to this embodiment without departing from the scope of the invention. In particular, the decision support application program (8), which is executable in the computer workstation (4) can provide a programming facility (not shown) that is selectively operable by the player to amend any one or more of the stored game play decisions in the rules database (7). In this manner, the player can amend the rules database (7) to conform to any desired playing strategy that the player wishes to adopt while playing the game. The rules database (7) can thus be amended to implement a playing strategy appropriate for any one or any one or more of a number of well-known variants of the game of blackjack. The programming facility also enables the player to automatically restore the rules database (7) to a default set of game play decisions. Further, as an alternative to providing the player with a recommended game play decision at every decision point in a turn of the game, the decision support application program (8) can be coupled to the stored program (6) in the computer workstation (4) to automatically control the progress of each turn of the game of blackjack without requiring intervention from the player.

Still further, the decision support software application program may be executed in the gaming server (3), instead of in the computer workstation (4). Yet further, the decision support system (1) can be applied to control the progress of a game of blackjack in self-contained apparati that do not operate in an on-line environment, such as electronic gaming devices of a type commonly found in land-based casinos, or hand-held electronic gaming devices. Finally, the recommended game play decision may be presented to the player at the computer workstation by means of an audible prompt instead of by means of a visible prompt such as a dialogue box or a button.

The invention therefore provides a novel decision support system and a method of operation thereof that enables a user to easily implement different playing strategies in a game of blackjack in an on-line environment.

The invention claimed is:

1. A decision support system, comprising:

a gaming server programmed to provide random events that simulate dealing individual cards to a player and to a dealer in a game of blackjack;

a rules database containing at least one stored game play decision for the player, wherein each of the at least one stored game play decision corresponds to a combination of a particular hand held by the player and a corresponding first card held by the dealer in the game of blackjack; and a computer workstation located remotely from the gaming server and communicable with the gaming server via a communication network, the computer workstation programmed to (i) allow the player to make wagers during the game of blackjack and to effect game play decisions during the game, and (ii) allow the player to amend the at least one stored game play decision in the rules database during the game.

2. A decision support system as claimed in claim 1, wherein the rules database contains stored game play decisions corresponding to every possible combination of a particular hand held by the player in the game of blackjack and a corresponding first card held by the dealer.

3. A decision support system as claimed in claim 1, wherein the at least one stored game play decision is at least one recommended game play decision for the player.

4. A decision support system as claimed in claim 3, wherein the at least one recommended game play decision is any one of a decision to hit, to stand, to split, to double, or to surrender.

5. A decision support system as claimed in claim 3, wherein the computer workstation is further programmed to perform a lookup in the rules database when a first two cards have been dealt to the player and a single card has been dealt to the dealer and to display to the player a recommended game play decision corresponding to the dealt cards.

6. A decision support system as claimed in claim 2, wherein the computer workstation is further programmed to automatically control the progress of at least one turn of the game of blackjack in accordance with the stored game play decisions in the rules database.

7. A method, comprising:

a gaming server providing random events that simulate dealing individual cards to a player and to a dealer in a game of blackjack;

executing a client process on a computer workstation located remotely from the gaming server and communicable with the gaming server via a communication network, wherein the client process allows the player to make wagers during the game of blackjack and to effect game play decisions during the game;

providing a rules database that contains at least one stored game play decision for the player, wherein each of the at least one stored game play decision corresponds to a combination of a particular hand held by the player and a corresponding first card held by the dealer in the game of blackjack; and executing a decision support application on the computer workstation, wherein the decision support application allows the player to amend the at least one stored game play decision in the rules database during the game.

8. A method as claimed in claim 7, wherein the rules database contains stored game play decisions corresponding to every possible combination of a particular hand held by the player in the game of blackjack and a corresponding first card held by the dealer.

9. A method as claimed in claim 8, further comprising:

recommending a stored game play decision to the player for a combination of a particular hand held by the player and a corresponding first card held by the dealer.

10. A method as claimed in claim 9, wherein recommending a stored game play decision to the player comprises:

recommending to the player any one of a decision to hit, to stand, to split, to double, or to surrender.

11. A method as claimed in claim 9, wherein recommending a stored game play decision to the player comprises:

displaying the recommended game play decision on the computer workstation.

12. A method as claimed in claim 8, further comprising:

automatically controlling the progress of at least one turn of the game of blackjack in accordance with the stored game play decisions in the rules database.

* * * * *